US008672438B2

(12) United States Patent
Sudo et al.

(10) Patent No.: US 8,672,438 B2
(45) Date of Patent: Mar. 18, 2014

(54) PRINTING DEVICE, PRINTING METHOD, AND PROGRAM

(75) Inventors: Naoki Sudo, Nagano (JP); Mai Kubota, Nagano (JP); Akito Sato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 334 days.

(21) Appl. No.: 13/110,063

(22) Filed: May 18, 2011

(65) Prior Publication Data

US 2011/0310150 A1 Dec. 22, 2011

(30) Foreign Application Priority Data

Jun. 22, 2010 (JP) ..... 2010-141416

(51) Int. Cl.
*B41J 2/05* (2006.01)

(52) U.S. Cl.
USPC ..... 347/15; 347/40; 347/43

(58) Field of Classification Search
USPC ..... 347/5, 9, 12, 15, 40, 43, 14
See application file for complete search history.

(56) References Cited

U.S. PATENT DOCUMENTS

| | | | | |
|---|---|---|---|---|
| 5,425,134 | A | 6/1995 | Ishida | |
| 5,898,208 | A | 4/1999 | Miyazaki et al. | |
| 6,045,210 | A | 4/2000 | Suzuki et al. | |
| 6,179,402 | B1 | 1/2001 | Suzuki et al. | |
| 6,328,400 | B1 | 12/2001 | Yonekubo et al. | |
| 6,336,705 | B1 * | 1/2002 | Torigoe | 347/43 |
| 6,540,329 | B1 | 4/2003 | Kaneko et al. | |
| 6,547,352 | B1 | 4/2003 | Ikeda | |
| 6,607,261 | B1 | 8/2003 | Shimada | |
| 6,692,096 | B1 | 2/2004 | Otsuki et al. | |
| 6,705,702 | B2 | 3/2004 | Gunther et al. | |
| 6,827,423 | B1 | 12/2004 | Katakura et al. | |
| 6,860,586 | B2 | 3/2005 | Ishikura | |
| 7,300,137 | B2 * | 11/2007 | Yamanaka et al. | 347/40 |
| 7,465,008 | B2 * | 12/2008 | Nunokawa et al. | 347/15 |
| 7,604,310 | B2 | 10/2009 | Sugimoto | |
| 7,758,156 | B2 | 7/2010 | Takuhara et al. | |
| 8,303,063 | B2 | 11/2012 | Kubota et al. | |
| 8,313,158 | B2 | 11/2012 | Kubota et al. | |
| 2001/0017638 | A1 | 8/2001 | Otsuki | |
| 2003/0081029 | A1 | 5/2003 | Underwood | |
| 2003/0081061 | A1 | 5/2003 | Gunther et al. | |
| 2004/0022570 | A1 | 2/2004 | Ioka et al. | |

(Continued)

FOREIGN PATENT DOCUMENTS

| | | | |
|---|---|---|---|
| EP | 0935213 | A2 | 8/1999 |
| EP | 0925931 | B1 | 7/2007 |

(Continued)

OTHER PUBLICATIONS

Extended European Search Report dated Aug. 11, 2011 for the corresponding European Patent Application No. 10187246.3.

*Primary Examiner* — Lam S Nguyen
(74) *Attorney, Agent, or Firm* — Global IP Counselors, LLP

(57) ABSTRACT

A printing device performs band printing during two-way printing, wherein the band printing uses black pigment ink and dye ink. In this printing device, in an advancing printed area for which a print head moves in an advancing direction, pigment ink dots are formed first and dye ink dots are formed second. In a retreating printed area for which the print head moves in a retreating direction, dye ink dots are formed first and pigment ink dots are formed second.

6 Claims, 14 Drawing Sheets

(56) References Cited

U.S. PATENT DOCUMENTS

| | | | |
|---|---|---|---|
| 2004/0080555 | A1 | 4/2004 | Otsuki et al. |
| 2004/0252160 | A1 | 12/2004 | Iwasaki et al. |
| 2005/0088483 | A1 | 4/2005 | Powers et al. |
| 2005/0200905 | A1 | 9/2005 | Kimura |
| 2006/0181561 | A1 | 8/2006 | Takahashi et al. |

FOREIGN PATENT DOCUMENTS

| | | | |
|---|---|---|---|
| JP | 03-045349 | A | 2/1991 |
| JP | 11-188896 | A | 7/1999 |
| JP | 2000-198227 | A | 7/2000 |
| JP | 2000-225719 | A | 8/2000 |
| JP | 2001-150793 | A | 6/2001 |
| JP | 2004-284064 | A | 10/2004 |
| JP | 2004-314534 | A | 11/2004 |
| JP | 2004-330624 | A | 11/2004 |
| JP | 2007-261205 | A | 10/2007 |
| JP | 2007-269021 | A | 10/2007 |
| JP | 2010-082822 | A | 4/2010 |

* cited by examiner

| | Pigment Ink | Dye Ink |
|---|---|---|
| Paper Seepage | Low (Does Not Run Readily) | High (Runs Readily) |
| Dot Diameter | Small | Large |
| Glossiness | Low | High |
| Color Hue | Near Magenta | Near Cyan |
| Concentration | High | Low |
| Water Resistance | High | Low |
| Weather Resistance | High | Low |
| Other | Good For Letter Printing | Good for Photograph Printing |

Fig. 4

PSEUDO BAND PRINTING

ADVANCING PRINTED AREA

RETREATING PRINTED AREA

COMPARATIVE EXAMPLE

COMPARATIVE EXAMPLE

PRINTING DEVICE, PRINTING METHOD, AND PROGRAM

CROSS-REFERENCE TO RELATED APPLICATIONS

This application claims priority to Japanese Patent Application No. 2010-141416 filed on Jun. 22, 2010. The entire disclosure of Japanese Patent Application No. 2010-141416 is hereby incorporated herein by reference.

BACKGROUND

1. Technical Field

The present invention relates to a printing technique which uses pigment ink and dye ink.

2. Related Art

One known example of a printing device is an inkjet printing device which forms a printed image by discharging ink from nozzles onto a print medium to form ink dots (Japanese Laid-Open Patent Application Publication No. 11-188896, for example). Among inkjet printing devices, there are those which perform printing using two types of ink: pigment ink and dye ink. The term "pigment ink" refers to ink that uses a pigment as the ink coloring, and the term "dye ink" refers to ink that uses dye as the ink coloring. In comparison with dye ink, pigment ink commonly does not run readily on print paper and has low transparency, and pigment ink is therefore suitable for printing letters and other solid images. In comparison with pigment ink, dye ink runs readily on print paper and has high transparency, and dye ink is therefore suitable for printing photograph images.

When both pigment ink and dye ink are used to form a printed image, it is known that there are cases in which the colors expressed have different concentrations, depending on the order in which the ink dots of pigment ink and the ink dots of dye ink overlap. In a printing device which moves a print head back and forth to perform two-way printing, when the pigment ink nozzles and the dye ink nozzles are arranged in parallel in the movement direction of the print head, there is a switching of the order in which the pigment ink and the dye ink are discharged between the advancing and retreating of the print head. Therefore, with such a printing device, tone properties differ between printed images formed during the advancing of the print head and printed images formed during the retreating, and there is a possibility that the quality of the printed image will decrease.

SUMMARY

An object of the present invention is to provide a technique for suppressing the decrease in quality of printed images formed by printing that uses pigment ink and dye ink.

The present invention was devised in order to resolve at least some of the problems described above, and the present invention can be implemented as the following aspects.

A printing device according to a first aspect includes: pigment ink nozzles arranged to discharge pigment ink to form pigment ink dots on a print medium; dye ink nozzles arranged to discharge dye ink to form dye ink dots on a print medium; and a nozzle control unit arranged to control sizes of the pigment ink dots and the dye ink dots by controlling ink quantities discharged from the pigment ink nozzles and the dye ink nozzles. The nozzle control unit is arranged to perform: a first printing process for forming pigment ink dot rows and dye ink dot rows adjacent to each other by causing the pigment ink nozzles to form the pigment ink dots and then causing the dye ink nozzles to form the dye ink dots adjacent to the pigment ink dots; and a second printing process for forming the dye ink dot rows and the pigment ink dot rows adjacent to each other by causing the dye ink nozzles to form the dye ink dots and then causing the pigment ink nozzles to form the pigment ink dots adjacent to the dye ink dots. The nozzle control unit is arranged to form a printed image including first and second printed image areas formed respectively by the first and second printing processes. When the nozzle control unit forms a first type of ink dots selected in advance from between two types of ink dots including the pigment ink dots and the dye ink dots in the first or second printing process, the nozzle control unit is arranged to perform a dot size adjustment process in which: the size of the first type of ink dots is not varied when the size of a second type of ink dots adjacent to the first type of ink dots is smaller than a preset size; and the size of the first type of ink dots is varied when the size of the second type of ink dots is equal to or greater than the preset size.

According to this printing device, even when there is a possibility of concentration discrepancies occurring between the first printed area and the second printed area due to a different order by which the pigment ink dots and dye ink dots overlap, the concentration in the first or second printed area can be adjusted by varying the size of the pigment ink dots or the dye ink dots, and the occurrence of concentration discrepancies can be suppressed. It is therefore possible to suppress the decrease in the quality of the printed image formed by printing using pigment ink and dye ink.

A printing device according to a second aspect is the printing device according the first aspect, wherein the nozzle control unit is preferably arranged to perform the dot size adjustment process in the first printing process, the first type of ink dots are the pigment ink dots, and the second type of ink dots are the dye ink dots.

According to this printing device, even when there is a possibility of concentration discrepancies occurring between the first printed area and the second printed area due to a different order by which the pigment ink dots and dye ink dots overlap, the concentration in the first printed area can be adjusted by varying the size of the pigment ink dots, and the occurrence of concentration discrepancies can be suppressed.

A printing device according to a third aspect is the printing device according to the first or second aspect, preferably further including a print head which has pigment ink nozzle rows and dye ink nozzle rows parallel to each other in which the pigment ink nozzles and the dye ink nozzles are aligned in an alignment direction at a prescribed nozzle pitch, and the print head being arranged to move back and forth in first and second directions that intersect the alignment direction of the pigment ink nozzle rows and the dye ink nozzle rows. The pigment ink nozzle rows and the dye ink nozzle rows is preferably disposed in the print head such that the pigment ink nozzle rows are nearer the first direction and the dye ink nozzle rows are nearer the second direction, the pigment ink nozzles and the dye ink nozzles being offset from each other in the alignment direction. The first printing process preferably includes a process for printing the first printed image area while moving the print head in the first direction. The second printing process preferably includes a process for printing the second printed image area while moving the print head in the second direction. The nozzle control unit is preferably arranged to form the printed image on the print medium by alternately performing the first and second printing processes.

According to this printing device, two-way printing can be performed using pigment ink and dye ink, and during this two-way printing it is possible to suppress concentration discrepancies that occur between a printed area formed during advancing printing and a printed area formed during retreating printing.

A printing device according to a fourth aspect is the printing device according to any of the first to third aspects, wherein the nozzle control unit is preferably arranged to vary at least one of either the preset size which is a threshold in the dot size adjustment process or a variation rate of the size of the first type of ink dots in the dot size adjustment process, the variation being according to the type of the print medium.

According to this printing device, even when the size of the ink dots formed on the print medium changes due to a different type of print medium, the decrease in print quality can be suppressed because a dot size adjustment process according to the type of the print medium can be performed.

A printing method according to a fifth aspect is a method performed by a printing device having dye ink nozzles for discharging dye ink and pigment ink nozzles for discharging pigment ink, the printing method including: forming a first printed image area including pigment ink dot rows and dye ink dot rows adjacent to each other by causing the pigment ink nozzles to form pigment ink dots and then causing the dye ink nozzles to form dye ink dots adjacent to the pigment ink dots; forming a second printed image area including dye ink dot rows and pigment ink dot rows adjacent to each other by causing the dye ink nozzles to form the dye ink dots and then causing the pigment ink nozzles to form the pigment ink dots adjacent to the dye ink dots; repeating the forming of the first printed image area and the forming of the second printed image area to form a printed image including the first printed image area and the second printed image area; and when a first type of ink dots selected in advance from between two types of ink dots including the pigment ink dots and the dye ink dots are formed during the forming of the first printed image area or the forming of the second printed image area, performing a dot size adjustment process in which the size of the first type of ink dots is not varied when the size of a second type of ink dots adjacent to the first type of ink dots is smaller than a preset size, and the size of the first type of ink dots is varied when the size of the second type of ink dots is equal to or greater than the preset size.

A non-transitory computer readable medium according to a sixth aspect has stored thereon a program which is executable by a computer to cause a printing device to perform printing, the printing device including pigment ink nozzles arranged to discharge pigment ink to form pigment ink dots on a print medium and dye ink nozzles arranged to discharge dye ink to form dye ink dots on a print medium. The program controls the computer to execute function of: controlling sizes of the pigment ink dots and the dye ink dots by controlling ink quantities discharged from the pigment ink nozzles and the dye ink nozzles; performing a first printing process for forming pigment ink dot rows and dye ink dot rows adjacent to each other by causing the pigment ink nozzles to form the pigment ink dots and then causing the dye ink nozzles to form the dye ink dots adjacent to the pigment ink dots, and a second printing process for forming the dye ink dot rows and the pigment ink dot rows adjacent to each other by causing the dye ink nozzles to form the dye ink dots and then causing the pigment ink nozzles to form the pigment ink dots adjacent to the dye ink dots; forming a printed image including first and second printed image areas formed respectively by the first and second printing processes; and when a first type of ink dots selected in advance from between two types of ink dots including the pigment ink dots and the dye ink dots are formed in the first or second printing process, performing a dot size adjustment process in which the size of the first type of ink dots is not varied when the size of a second type of ink dots adjacent to the first type of ink dots is smaller than a preset size, and the size of the first type of ink dots is varied when the size of the second type of ink dots is equal to or greater than the preset size.

The present invention can be implemented in various aspects, e.g., a printing device and a printing method, a control method of a printing device and a control device, a computer program for implementing the functions of these methods or devices, a storage medium on which this computer program is stored, and the like.

BRIEF DESCRIPTION OF THE DRAWINGS

Referring now to the attached drawings which form a part of this original disclosure:

FIG. 4 is an explanatory chart showing a compilation of the characteristics of the black pigment ink and dye ink used in the printing device of the present embodiment;

DETAILED DESCRIPTION OF EXEMPLARY EMBODIMENTS

A. First Embodiment

Figure 1:
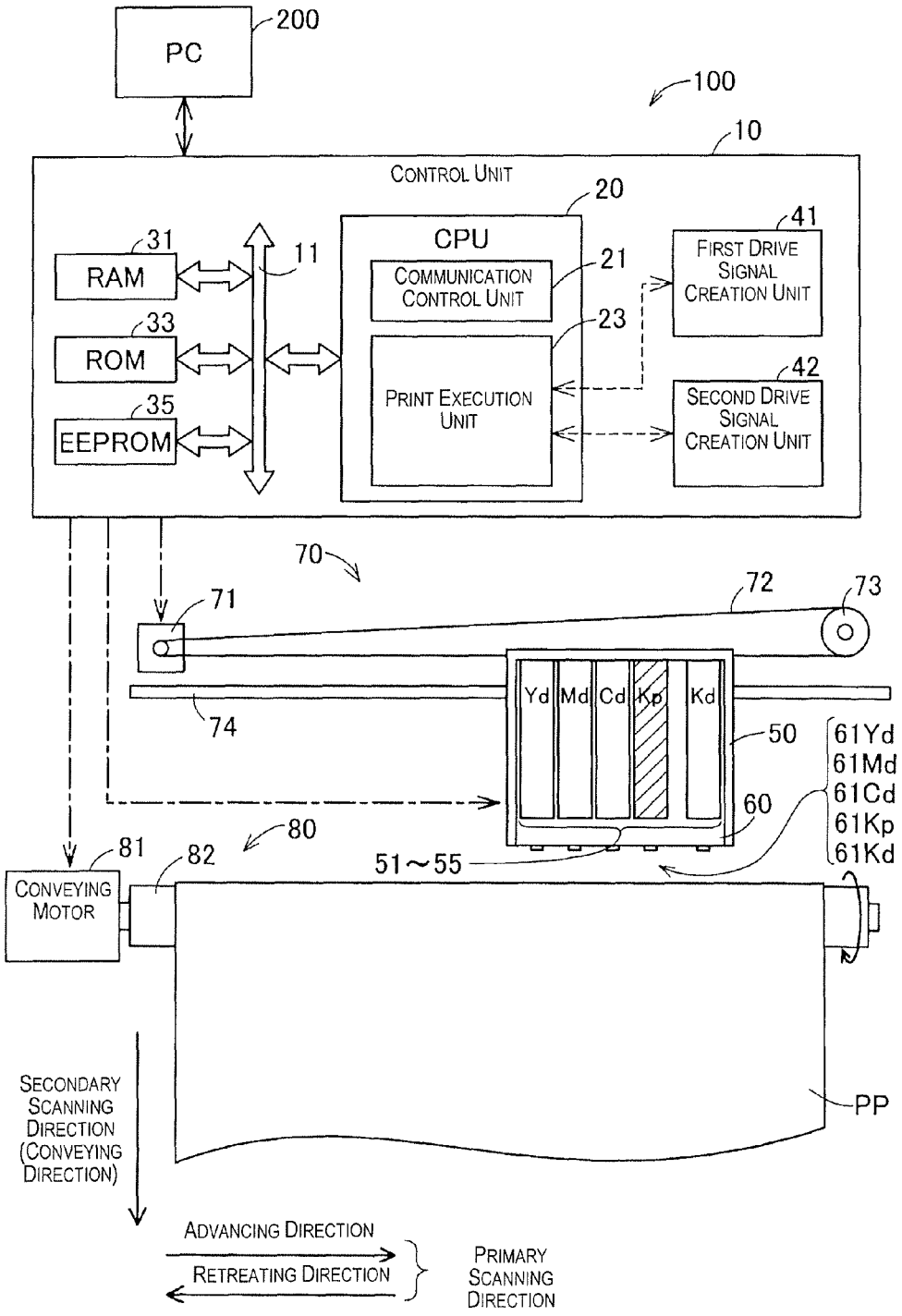
FIG. 1 is a schematic diagram showing the configuration of a printing device.

FIG. 1 is a schematic diagram of the configuration of a printing device 100 as an embodiment of the present invention. This printing device 100 is an inkjet printer which discharges ink droplets onto paper PP as a print medium and forms printed images by the formed ink dots, and the printing device 100 performs a printing process by two-way printing.

The printing device 100 comprises a control unit 10, a carriage 50, a print head 60, a carriage drive unit 70, and a paper conveying unit 80.

The control unit 10 comprises a CPU 20, a RAM 31, a ROM 33, an EEPROM 35, and first and second drive signal creation units 41, 42. The CPU 20, the RAM 31, the ROM 33, and the EEPROM 35 are connected to each other by an internal bus 11. The CPU 20 functions as a communication control unit 21 and a print execution unit 23 by reading programs stored in advance in the ROM 33 and the EEPROM 35 and opening and running the programs in the RAM 31.

The communication control unit 21 controls communication between the printing device 100 and a personal computer (PC) 200 and other external devices connected to the printing device 100. The print execution unit 23 controls the structural components of the printing device 100 and executes the printing process on the basis of print data received from the personal computer 200. The first and second drive signal creation units 41, 42 each create a drive signal for driving the nozzles by a directive from the print execution unit 23. The details of the specific drive signals are described hereinafter.

Five ink cartridges 51 to 55 are mounted in the carriage 50. The first through third ink cartridges 51 to 53 respectively contain yellow dye ink (Yd), magenta dye ink (Md), and cyan dye ink (Cd). The fourth ink cartridge 54 contains black pigment ink (Kp), and the fifth ink cartridge 55 contains black dye ink (Kd). Specifically, with this printing device 100, color printing is possible with dye ink printing, and monochrome printing is possible with both dye ink printing and pigment ink printing.

The print head 60 is disposed in the bottom part of the carriage 50. In the bottom surface of the print head 60 (the surface that faces the paper PP), first through fifth nozzles 61Yd, 61Md, 61Cd, 61Kp, and 61Kd are provided for discharging the colored dye inks and the black pigment ink.

The aforementioned ink cartridges 51 to 55 are installed above the nozzles 61Yd, 61Md, 61Cd, 61Kp, and 61Kd of the corresponding colors, and the ink cartridges supply ink to the nozzles 61Yd, 61Md, 61Cd, 61Kp, and 61Kd. The arranged configuration of the nozzles 61Yd, 61Md, 61Cd, 61Kp, and 61Kd in the bottom surface of the print head 60 will be described hereinafter.

The carriage drive unit 70 is a drive mechanism for moving the carriage 50 back and forth in a linear direction (the left-right direction of the image plane in FIG. 1) along the surface of the paper PP. The carriage drive unit 70 comprises a carriage motor 71, a drive belt 72, a pulley 73, and a sliding shaft 74. The sliding shaft 74 extends in the movement direction of the carriage 50 and holds the carriage 50 in a slidable manner. The drive belt 72 is an endless belt harnessed between the carriage motor 71 and the pulley 73, and the carriage 50 is attached to the drive belt 72 in a stationary manner.

The carriage motor 71 is rotatably driven by a directive from the print execution unit 23. The carriage 50 and the print head 60 attached to the drive belt 72 are moved back and forth along the print surface of the paper PP in accordance with the rotational driving of the carriage motor 71. In this Specification, the back-and-forth movement direction of the carriage 50 and the print head 60 is referred to as the "primary scanning direction," and for the sake of convenience, the image-plane-right direction and image-plane-left direction in particular in FIG. 1 are referred to respectively as the "advancing direction" and the "retreating direction."

The paper conveying unit 80 comprises a conveying motor 81 and a platen 82. The platen 82 is a rotating shaft extending in a direction parallel with the primary scanning direction, and is rotated by the conveying motor 81. The conveying motor 81 is driven according to a directive from the print execution unit 23. During the printing process, the paper PP is placed on the side surface of the platen 82 and is conveyed by the rotation of the platen 82. In this Specification, the direction in which the paper PP is conveyed during the printing process is referred to simply as the "conveying direction" or the "secondary scanning direction."

When the print execution unit 23 receives print data from the personal computer 200, a printing process is performed with two-way printing. Specifically, the print execution unit 23 moves the print head 60 a fixed distance in the advancing direction or the retreating direction and causes ink to be discharged from the nozzles 61Yd, 61Md, 61Cd, 61Kp, 61Kd of each color in accordance with the print data. The print execution unit 23 executes the discharge of ink by acquiring the drive signals created by the first and second drive signal creation units 41, 42 and applying the signals to the nozzles in accordance with the print data. Rows of ink dots aligned along the primary scanning direction are formed on the paper PP by repeating the movement of the print head 60 and the discharge of ink.

After the print head 60 has finished scanning in the advancing direction or the retreating direction, the print execution unit 23 moves the paper PP a predetermined conveying distance in the conveying direction. The print execution unit 23 then causes the print head 60 to begin scanning in the direction opposite the previously mentioned scanning direction, and executes the discharging of ink from the nozzles 61Yd, 61Md, 61Cd, 61Kp, 61Kd in accordance with the print data. An ink dot row parallel to the previously formed ink dot row is thereby formed on the paper PP. With the printing device 100, a printed image is formed by alternately repeating the formation of ink dot rows by the scanning of the print head 60 in the primary scanning direction and the conveying of the paper PP.

Figure 2:
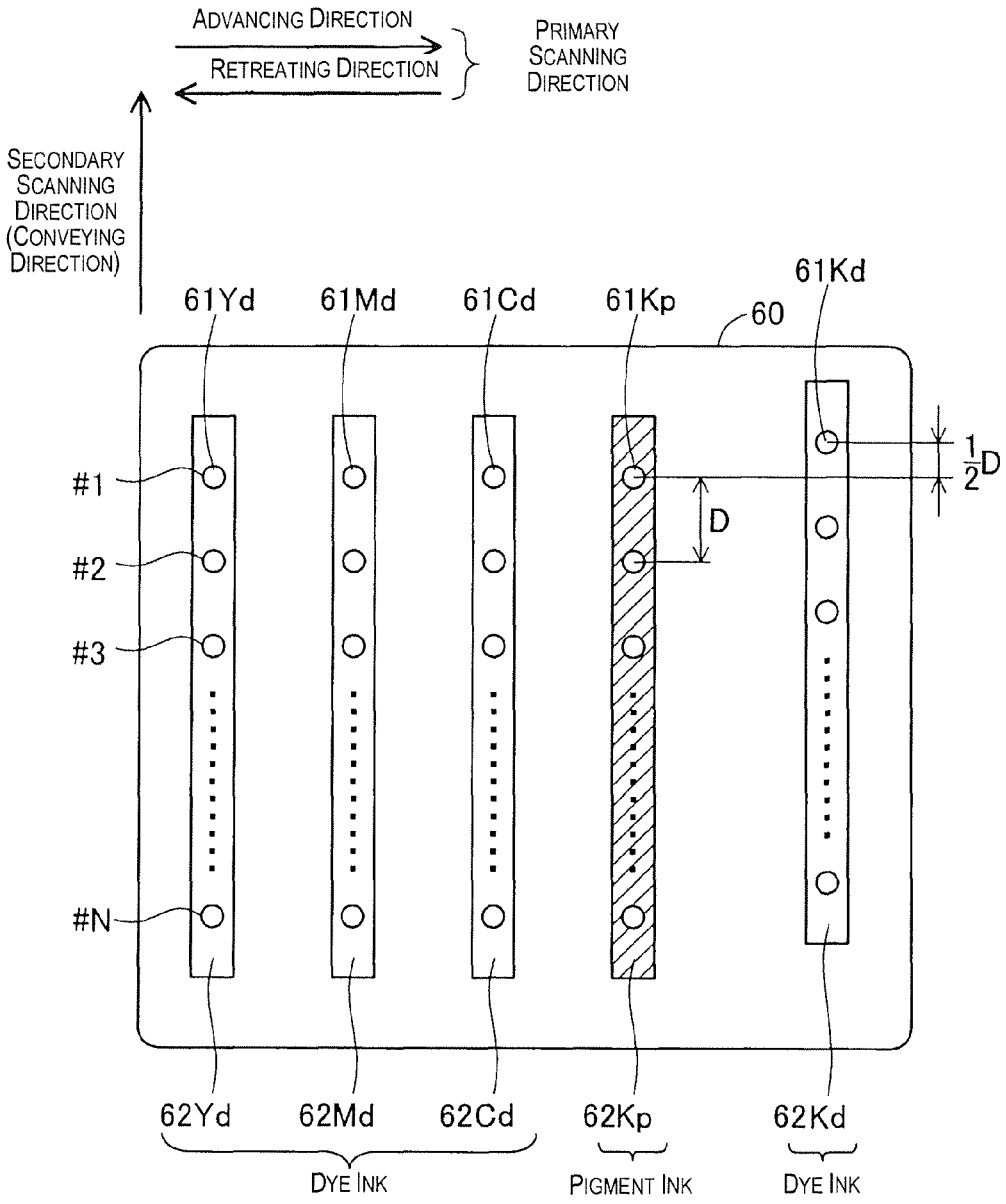
FIG. 2 is a schematic diagram for describing the arrangement configuration of nozzles provided to a print head.

FIG. 2 is a schematic diagram for describing the arrangement configuration of the nozzles provided to the print head 60. FIG. 2 shows a schematic depiction of the bottom surface (the surface that faces the paper PP) of the print head 60. The nozzles 61Yd, 61Md, 61Cd, 61Kp, 61Kd are aligned in rows of N nozzles (N being an arbitrary natural number) aligned along the secondary scanning direction, constituting first through fifth nozzle rows 62Yd, 62Md, 62Cd, 62Kp, 62Kd. Specifically, the first through third nozzle rows 62Yd, 62Md, 62Cd are configured from nozzles 61Yd, 61Md, 61Cd for yellow, magenta, and cyan dye ink. The fourth and fifth nozzle rows 62Kp, 62Kd are configured from nozzles 61Kp, 61Kd for black pigment ink and black dye ink.

The nozzles 61Yd, 61Md, 61Cd, 61Kp, 61Kd are aligned at substantially constant intervals D (hereinafter referred to as the "nozzle pitch D") within the nozzle rows 62Yd, 62Md, 62Cd, 62Kp, 62Kd. The nozzles 61Yd, 61Md, 61Cd, 61Kp of the first through fourth nozzle rows 62Yd, 62Md, 62Cd, 62Kp are also provided so that the nozzles of each color are arrayed in straight lines along the primary scanning direction. The nozzles 61Kd of the fifth nozzle row 62Kd are provided so as to be offset from the nozzles 61Kp of the fourth nozzle row 62Kp by a distance half of the nozzle pitch D (½ D).

Such an arrangement configuration of the nozzles 61Yd, 61Md, 61Cd, 61Kp, 61Kd allows the printing device 100 of the present embodiment to suitably perform two printing processes: pseudo band printing using dye ink, and band printing using pigment ink and dye ink. Pseudo band printing and band printing will be described hereinafter.

Figure 3A:
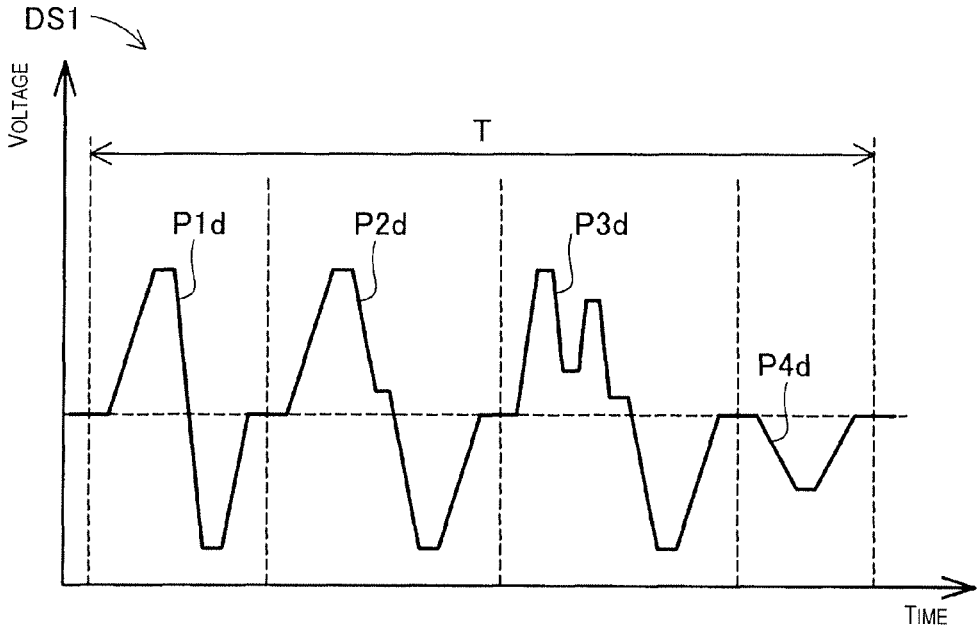
FIGS. 3A and 3B are schematic diagrams showing examples of drive signals created by first and second drive signal creation units.
Figure 3B:
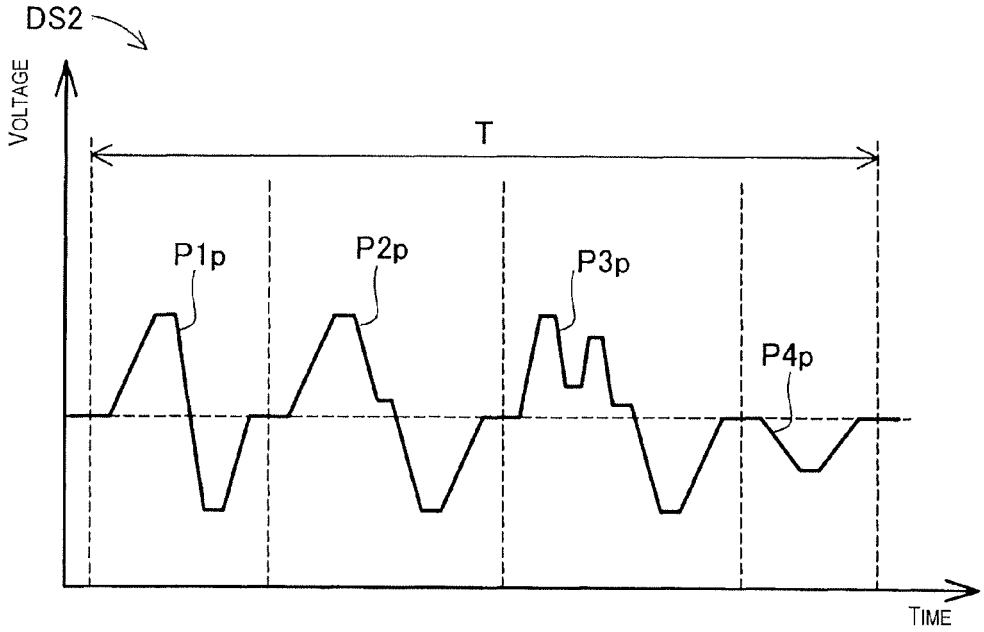

FIGS. 3A and 3B are schematic diagrams each showing an example of a drive signal created by the first and second drive signal creation units 41, 42, respectively. FIGS. 3A and 3B are respectively are a diagram showing the first and second drive signals DS1 and DS2 on the vertical axis and time on the horizontal axis. First and second drive signals DS1, DS2 are created based on drive signal creation data expressing an electric potential variation pattern stored in advance in the ROM 33. The drive signal creation data is read from the ROM 33 by the print execution unit 23 and transmitted to the first and second drive signal creation units 41, 42.

The first drive signal DS1 created by the first drive signal creation unit 41 is supplied to the nozzles 61Yd, 61Md, 61Cd, 61Kd for the dye inks of the different colors. The second drive signal DS2 created by the second drive signal creation unit 42 is supplied to the nozzles 61Kp of black pigment ink. The signal pulse width and amplitude are varied between the first drive signal DS1 and the second drive signal DS2 in accordance with the respective ink characteristics (described hereinafter) of the pigment ink and the dye ink.

The first drive signal DS1 for dye ink (FIG. 3A) has first through fourth drive pulses P1*d* to P4*d*. The first through third drive pulses P1*d*, P2*d*, P3*d* are pulses for forming large, medium, and small dots of dye ink, respectively. The fourth drive pulse P4*d* is a pulse for causing the nozzles 61Yd, 61Md, 61Cd, 61Kd to not discharge ink. The second drive signal DS2 for pigment ink (FIG. 3B) has first through fourth drive pulses P1*p* to P4*p*, similar to the first drive signal DS1.

The first and second drive signals DS1, DS2 are both repeatedly created in constant cycles T, and are transmitted to the nozzles 61Yd, 61Md, 61Cd, 61Kp, 61Kd corresponding to the print head 60. The cycles T of the first and second drive signals DS1, DS2 are both stipulated by a latch pulse (not shown) transmitted to both the first and second drive signals DS1, DS2. The transmission periods of the pulses P1*d* to P4*d* and P1*p* to P4*p* of the first and second drive signals DS1, DS2 are similarly stipulated by a change pulse (not shown) transmitted to both the first and second drive signals DS1, DS2.

The nozzles 61Yd, 61Md, 61Cd, 61Kp, 61Kd are communicated with ink chambers filled with ink, and piezo elements functioning as pressure-generating elements are disposed on the walls of the ink chambers. Any of the drive pulses P1*d* to P4*d* and P1*p* to P4*p* included in the drive signals DS1, DS2 is applied to the piezo elements corresponding to the nozzles 61Yd, 61Md, 61Cd, 61Kp, 61Kd. The drive pulses applied to the nozzles 61Yd, 61Md, 61Cd, 61Kp, 61Kd are selected by the print execution unit 23 for each nozzle in accordance with the dot size established based on the print data.

The piezo elements deform according to the variation in the electric potential of the applied drive pulse and vary the pressure in the ink chambers. Ink droplets in an ink quantity corresponding to the pressure vary in the ink chambers are thereby discharged from the nozzles. The fourth drive pulses P4*d*, P4*p* are applied to the nozzles 61Yd, 61Md, 61Cd, 61Kp, 61Kd even when ink is not discharged. The pressure in the ink chambers is varied by these pulses P4*d*, P4*p*, whereby the ink menisci formed in the nozzle openings vibrate and thickening of the ink near the nozzle openings is suppressed.

FIG. 4 is an explanatory chart showing a compilation of the characteristics of the black pigment ink and dye ink used in the printing device 100 of the present embodiment. Commonly, even if the pigment ink and the dye ink are the same black, they differ in terms of their color hues and the readiness of their ink components to seep into the paper PP (referred to as "paper seepage" in this Specification). To compare pigment ink and dye ink, the paper seepage is lower with pigment ink and higher with dye ink. Specifically, the ink droplets of the pigment ink do not run readily into the print paper, while the ink droplets of the dye ink do run readily into the print paper. This is because with pigment ink, the pigment components are readily retained on the surface of the print paper.

Because of such a difference in paper seepage, when ink of the same amount is discharged from both the nozzles 61Kp and 61Kd of the print head 60, the size of the ink dots formed on the paper PP tends to be smaller in the pigment ink than in the dye ink. Unevenness in the surfaces of the ink dots of pigment ink is formed by the pigment components remaining on the surface of the paper PP. Therefore, the printed image formed by the ink dots of pigment ink has less glossiness than the printed image formed by dye ink.

Furthermore, as for color hue, the black pigment ink has a color hue near that of magenta, and the black dye ink has a color hue near that of cyan. Therefore, when the printed image formed by pigment ink and the printed image formed by dye ink have the same ink quantity included per unit surface area, the printed image of pigment ink has a higher concentration than the printed image of dye ink.

As another example of a difference in ink characteristics, pigment ink has higher water resistance and weather resistance than dye ink. Pigment ink is commonly suitable for printing letters because of its lack of running and higher concentration of coloring, while dye ink is commonly suitable for printing photograph images because of its readiness to run and transparency.

Figure 5A:
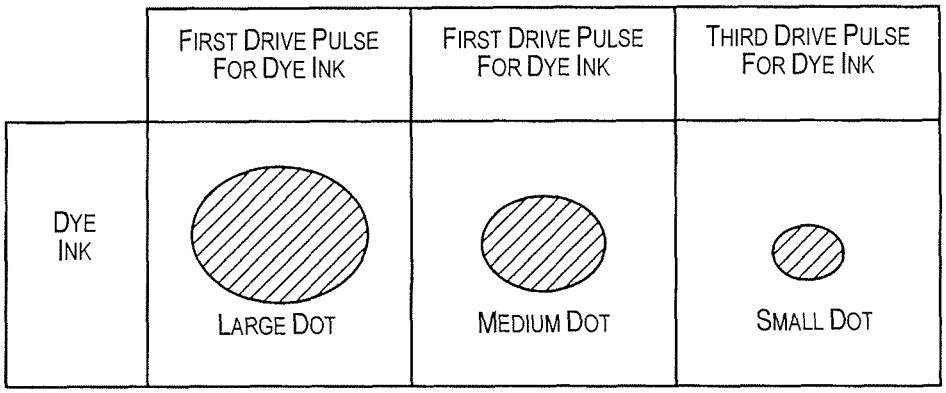
FIGS. 5A and 5B are schematic diagrams for describing the difference between pigment ink dots and dye ink dots formed on the paper.
Figure 5B:
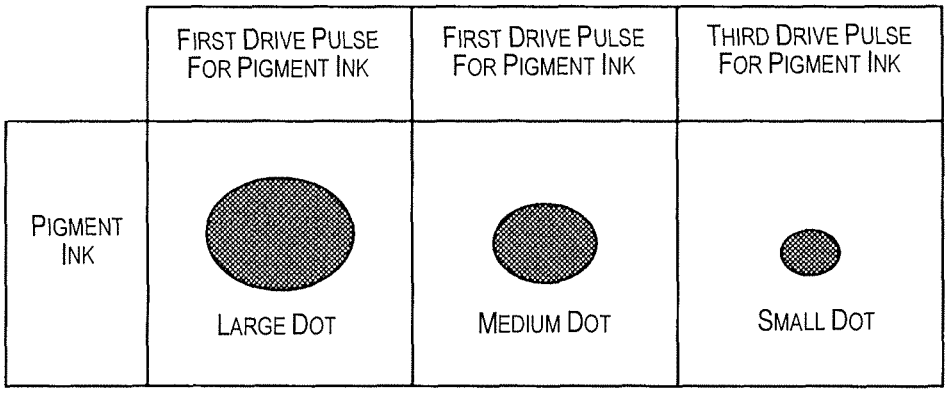

FIGS. 5A and 5B are schematic diagrams for describing the difference between pigment ink dots and dye ink dots formed on the paper PP by the printing device 100 of the present embodiment. This diagram schematically depicts the difference in ink dot size and the difference in concentration between the pigment ink and the dye ink. With the printing device 100 of the present embodiment, large dots, medium dots, and small dots are formed with both pigment ink and dye ink on the paper PP by the drive pulses P1*d* to P3*d* and P1*p* to P3*p*, as described in FIGS. 3A and 3B.

However, even if the ink dots are formed with similar dot sizes, the pigment ink dots are designed to be formed with a comparatively smaller size than the dye ink dots. The reason for this is because when only pigment ink is used to form solid images of the same concentration on the paper PP, a lesser quantity of ink can be included per unit surface area than when only dye ink is used to form solid images of a uniform concentration on the paper PP.

The printing device 100 of the present embodiment performs both pseudo band printing using only dye ink and band printing using both pigment ink and dye ink as previously described. Specifically, pseudo band printing is performed for color printing of photograph images and the like, and band printing is performed for monochrome images or black letter printing.

Figure 6A:
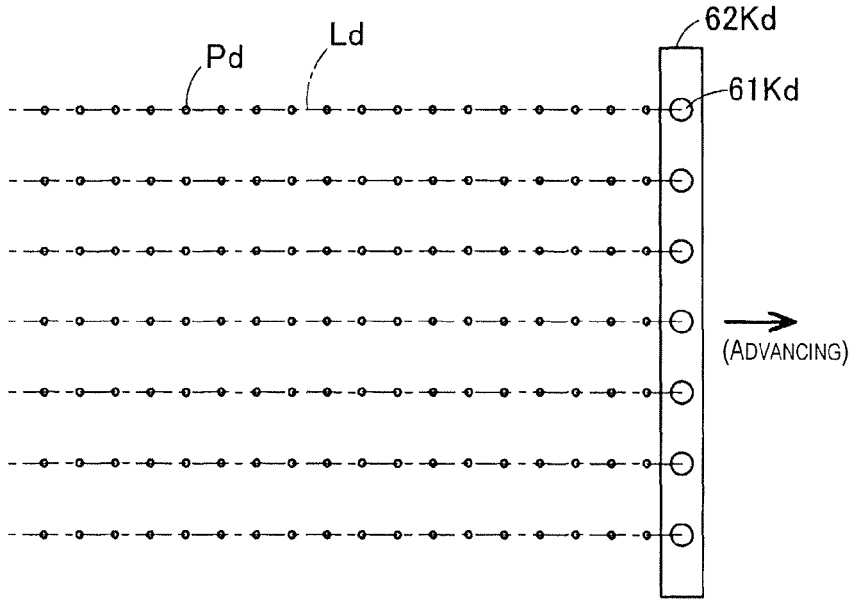
FIGS. 6A and 6B are schematic diagrams showing the sequence of the steps of pseudo band printing using dye ink.
Figure 6B:
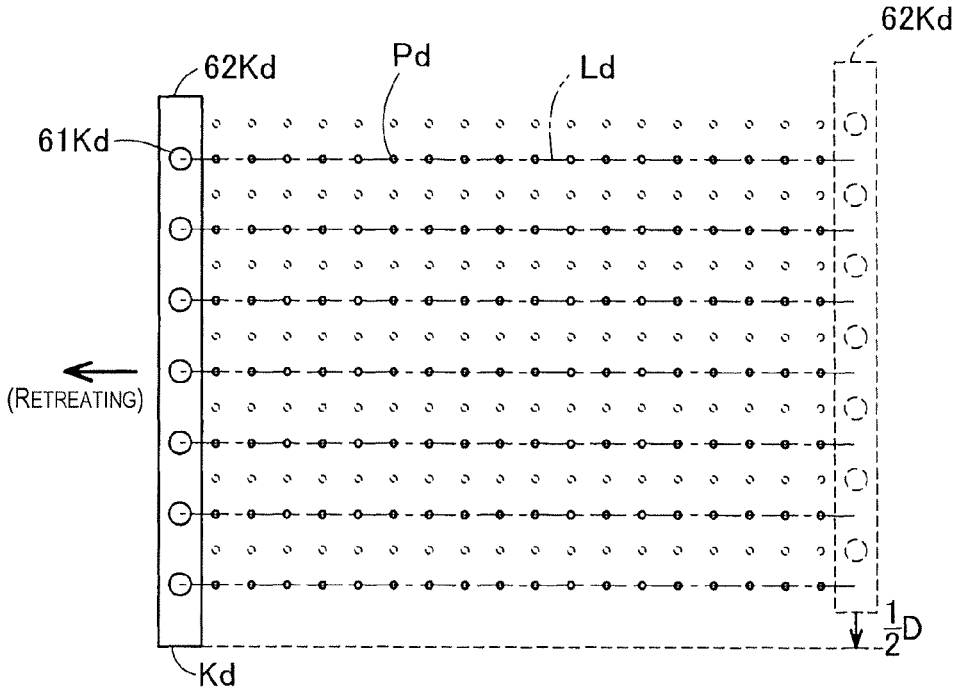

FIGS. 6A and 6B are schematic diagrams showing the sequence of the process of pseudo band printing using dye ink. FIGS. 6A and 6B both show the fifth nozzle row 62Kd for black dye ink in the print head 60. For the sake of convenience, FIGS. 6A and 6B show seven (N=7) nozzles 61Kd of the fifth nozzle row 62Kd. In FIGS. 6A and 6B, the movement trajectories Ld of the nozzles 61Kd in pseudo band printing are shown as single-dash lines, and the discharge positions Pd of the black dye ink are shown as white circles on these lines.

Furthermore, for the sake of convenience, FIG. 6B uses dashed lines to show the position of the fifth nozzle row 62Kd immediately after the process of FIG. 6A has finished, as well as the ink discharge positions Pd in the process of FIG. 6A. When a color image is printed, pseudo band printing by the other dye ink nozzle rows 62Yd, 62Md, 62Cd is also performed in parallel, but the specifics thereof are similar to those of the fifth ink nozzle row 62Kd and are therefore not illustrated or described.

In pseudo band printing, the print execution unit 23 moves the fifth ink nozzle row 62Kd (the print head 60) in the advancing direction and causes ink to be discharged at intervals according to the pixel pitch of the printed image (FIG. 6A). Ink dots rows parallel to each other in the secondary scanning direction and separated by the nozzle pitch D are thereby formed on the paper PP in a number corresponding to the number of nozzles 61Kd.

Next, the print execution unit 23 moves the paper PP in the conveying direction by a distance of half the nozzle pitch D (½D). The print execution unit 23 then moves the print head 60 in the retreating direction and cause ink to be discharged at intervals according to the pixel pitch of the printed image (FIG. 6B). New ink dot rows are thereby formed adjacent to the parallel ink dot rows formed in the process of FIG. 6A).

After the process of forming ink dot rows in FIG. 6B, the print execution unit 23 moves the paper PP equivalent to one band (specifically, a distance equal the number of nozzles N×the nozzle pitch D) and again performs the same process of forming ink dots rows in the advancing direction as in FIG. 6A. Specifically, with this pseudo band printing, an equivalent of one band of the printed image is formed by a single back-and-forth scan of the print head 60, and the printed image is formed by repeating this single band equivalent printing.

Figure 7B:
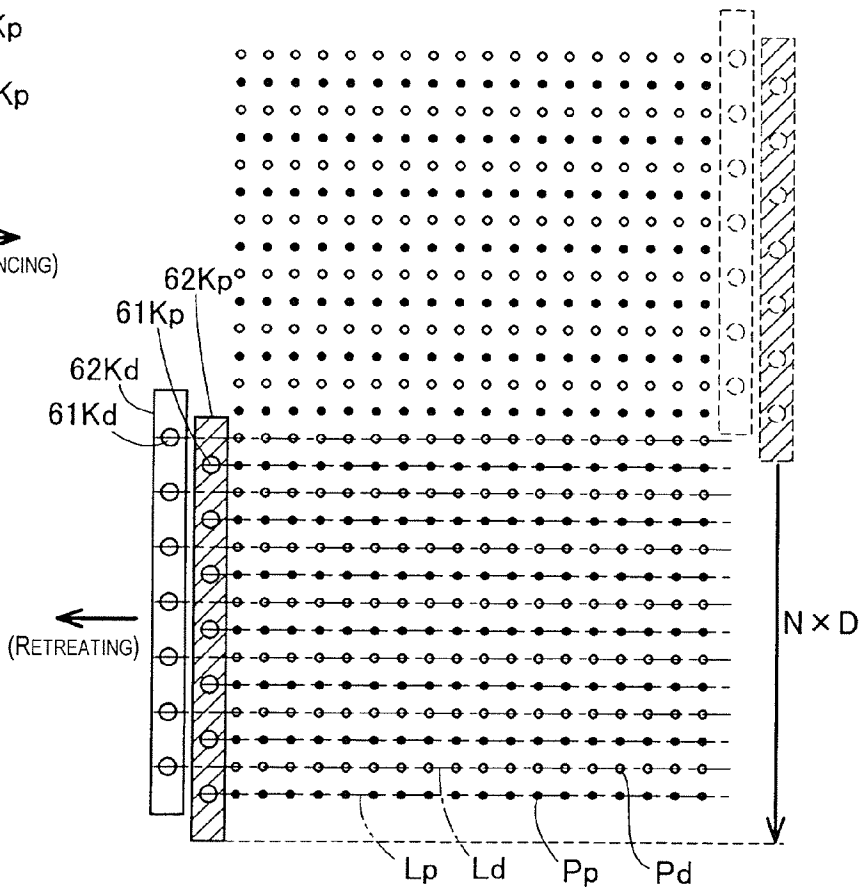
FIGS. 7A and 7B are schematic diagrams showing the sequence of the process of band printing which is performed using black dye ink and pigment ink.
Figure 7A:
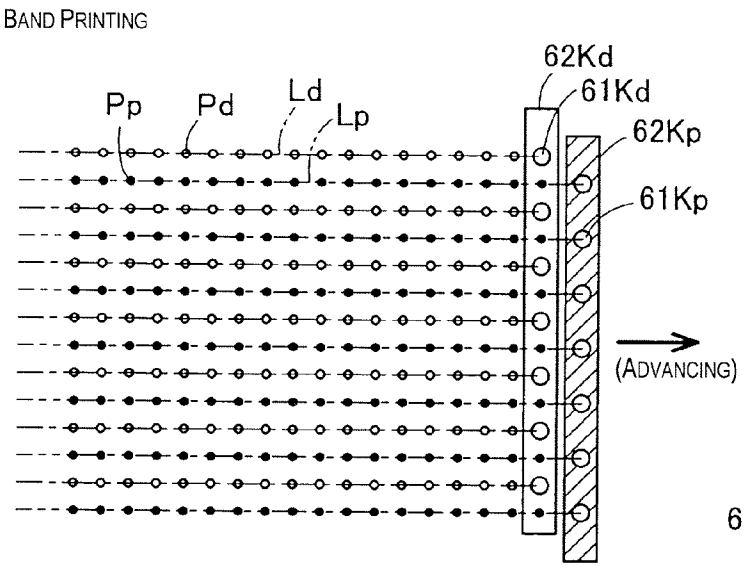

FIGS. 7A and 7B are schematic diagrams similar to FIGS. 6A and 6B, showing the sequence of the process of band printing which is performed using black dye ink and pigment ink. FIGS. 7A and 7B show the fourth and fifth nozzle rows 62Kp, 62Kd in the print head 60.

FIGS. 7A and 7B show single-dash lines and double-dash lines indicating the respective movement trajectories Lp, Ld of the nozzles 61Kp, 61Kd in band printing, as well as black circles and white circles indicating the discharge positions Pp, Pd of the black pigment ink and dye ink. For the sake of convenience, FIG. 7B shows the ink discharge positions Pp, Pd in the process of FIG. 7A, and the arranged positions of the fourth and fifth nozzle rows 62Kp, 62Kd immediately after completion of the process of FIG. 7A are shown in dashed lines.

In band printing, the print execution unit 23 moves the fourth and fifth nozzle rows 62Kp, 62Kd (the print head 60) in the advancing direction and causes black pigment ink and dye ink to be discharged at intervals according to the pixel pitch of the printed image (FIG. 7A). Ink dot rows (dye ink dot rows and pigment ink dot rows aligned alternately in the secondary scanning direction) parallel to each other and separated by a distance of half the nozzle pitch D (½D) are thereby formed on the paper PP in a number corresponding to the number N of nozzles 61Kp, 61Kd.

Next, the print execution unit 23 moves the paper PP by a distance (N×D) equivalent to one band in the conveying direction. While then moving the print head 60 back the other way in the retreating direction, print execution unit 23 discharged black pigment ink and dye ink at intervals according to the pixel pitch of the printed image (FIG. 7B). A group of new ink dot rows is thereby formed downstream in the conveying direction from the groups of parallel ink dot rows formed in the process described in FIG. 7A.

Specifically, in band printing, an equivalent of two bands of the printed image is formed by a single back-and-forth scan of the print head 60, and a printed image is formed by repeating this two-band printing. Thus, when a monochrome printed image is printed with the printing device 100 of the present embodiment, performing this band printing makes it possible to print at a faster speed than printing by pseudo band printing.

In this Specification, within the printed image formed by band printing, the area of the printed image that is formed when the print head 60 moves in the advancing direction is referred to as the "advancing printed area." The area of the printed image that is formed when the print head 60 moves in the retreating direction is referred to as the "retreating printed area."

Figure 8A:
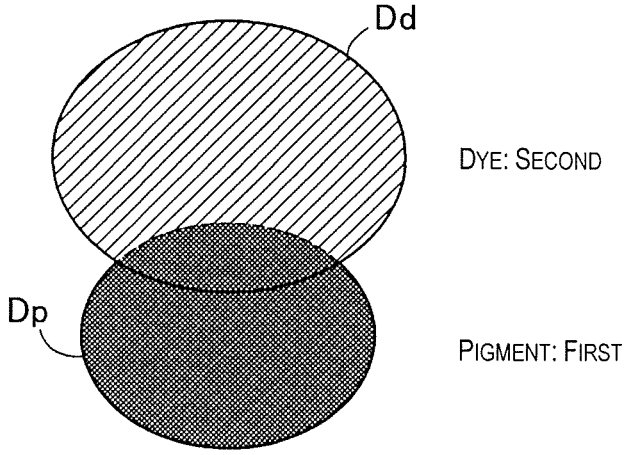
FIGS. 8A to 8C are schematic drawings for describing the overlapping between pigment ink dots and dye ink dots in band printing.
Figure 8B:
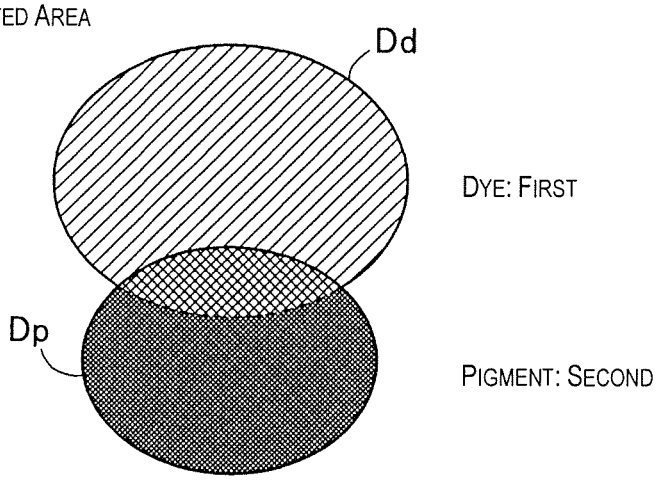

FIGS. 8A and 8B are schematic drawings for describing the overlapping between pigment ink dots and dye ink dots in band printing. In a printed image formed by band printing, a pigment ink dot Dp and a dye ink dot Dd are arranged in a row along the conveying direction (FIGS. 7A and 7B). The pigment ink dot Dp and the dye ink dot Dd, which are adjacent to each other, also overlap each other depending on the combination of their dot sizes.

FIGS. 8A and 8B schematically show the overlapping between ink dots Dp, Dd of a large dot size (FIGS. 5A and 5B). FIG. 8A shows a state in which the pigment ink dot Dp and the dye ink dot Dd overlap each other in the advancing printed area, and FIG. 8B shows a state in which the pigment ink dot Dp and the dye ink dot Dd overlap each other in the retreating printed area.

When printing is performed in the advancing direction during band printing, the print head 60 moves such that the fourth nozzle row 62Kp for black pigment ink is forward and the fifth nozzle row 62Kd for black dye ink is rearward (FIG. 7A). Therefore, during printing in the advancing printed area, the adjacent dye ink dot Dd is formed after the pigment ink dot Dp (FIG. 8A).

When printing is performed in the retreating direction during band printing, the print head 60 moves such that the fifth nozzle row 62Kd for black dye ink is forward and the fourth nozzle row 62Kp for black pigment ink is rearward (FIG. 7B). Therefore, during printing in the retreating printed area, the adjacent pigment ink dot Dp is formed after the dye ink dot Dd (FIG. 8B).

When dye ink is discharged over the pigment ink dot Dp formed on the paper PP (FIG. 8A), the pigment components of the pigment ink having a dark color hue cover the external surface of the paper PP, and the pigment ink is then overlapped by the dye ink having a light color hue and high transparency. In this case, the concentration of the area where the dots Dp, Dd overlap each other is substantially the same as the concentration of the pigment ink dot.

When pigment ink is discharged on top of a dye ink dot (FIG. 8B), the pigment components of the pigment ink seep or diffuse into the components of the dye ink that have seeped into the paper PP. Therefore, the concentration in the area where the dots overlap is less than in FIG. 8A.

Figure 8C:
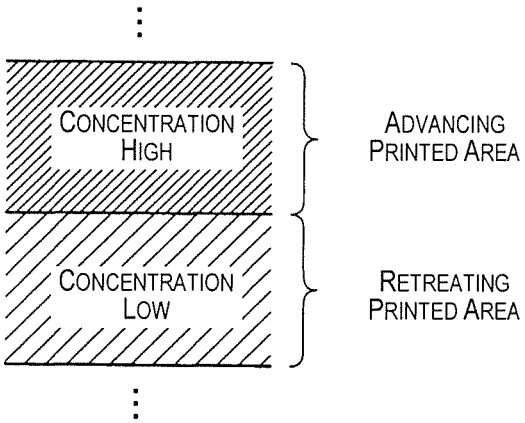

FIG. 8C is a schematic diagram showing a printed image in a case in which ink dots of a large dot size have been produced by the nozzles 61Kp, 61Kd during band printing by the printing device 100 of the present embodiment. In this case, the overlapping between dots of pigment ink and dye ink in the advancing printed area is similar to FIG. 8A, and the overlapping between dots of pigment ink and dye ink in the retreating printed area is similar to FIG. 8B. Thus, the overall concentration differs between the advancing printed area and the retreating printed area, in accordance with the concentration difference in the area where the ink dots overlap each other. Specifically, the concentration is higher in the advancing printed area, and the concentration is lower in the retreating printed area.

In other words, in the band printing performed by the printing device 100 of the present embodiment, even if the dots formed in the advancing printed area and the retreating printed area have the same alignment configuration, the concentrations in these areas differ depending on the extent of overlap between pigment ink and dye ink dots. In the printing device 100 of the present embodiment, the print execution unit 23 performs a control process described hereinbelow in order to suppress the occurrence of concentration differences between the advancing printed area and the retreating printed area.

Figure 9:
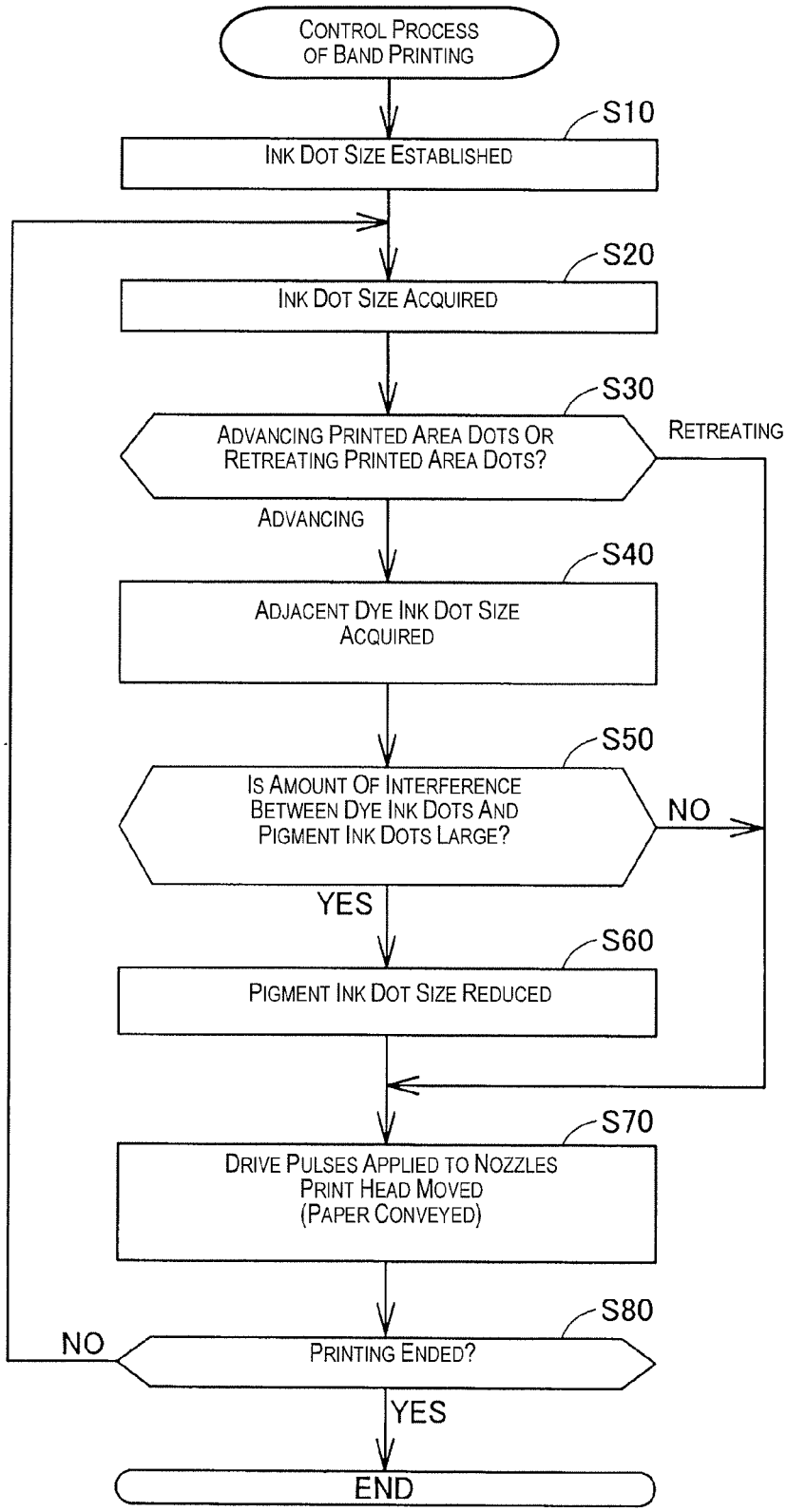
FIG. 9 is a flowchart showing the sequence of the control process performed by the print execution unit during band printing.

FIG. 9 is a flowchart showing the sequence of the control process performed by the print execution unit 23 during band printing. In step S10, based on the print data, the print execution unit 23 establishes the ink dot size for each ink dot formed. The ink dot size may be established using a dot alignment pattern or map for each printed image concentration, which has been prepared in advance.

In step S20, the print execution unit 23 acquires the size of the ink dots to be formed at the current disposed positions of the nozzles 61Kp, 61Kd. In step S30, the print execution unit 23 specifies from the movement direction of the print head 60 whether the ink dots formed are ink dots in the advancing printed area or ink dots in the retreating printed area. When ink dots are formed in the advancing printed area, the print execution unit 23 adjusts the size of the ink dots to be formed by the pigment ink through the process of steps S40 to S60. When ink dots are formed in the retreating printed area, the print execution unit 23 performs the process of step S70.

In step S40, the print execution unit 23 acquires the size of the dye ink dots (hereinbelow referred to simply as "adjacent dye ink dots") formed in positions adjacent in the secondary scanning direction to the pigment ink dots formed in the ink discharge step. Specifically, the size of the adjacent dye ink dots formed in the subsequent ink discharge step is acquired. In step S50, a determination of the extent of overlap (amount of interference) between the pigment ink dots and the adjacent dye ink dots is made from the combination of the size of pigment ink dots formed in this ink discharge step and the size of adjacent dye ink dots acquired in step S30. When it is determined through this determination process that there is a large amount of interference between the pigment ink dots and the adjacent dye ink dots, the printing device 100 of the present embodiment reduces the size of the pigment ink dots that will be formed (step S50).

FIGS. 10A to 10D are schematic diagrams for describing the process of adjusting the size of pigment ink dots Dp in steps S50 to S60. In the printing device 100 of the present embodiment, when the ink dots Dp, Dd have the combinations shown in FIGS. 10A through 10D, the pigment ink dots Dp are formed with a reduced dot size assuming a large extent of overlap between the ink dots Dp, Dd. FIGS. 10A through 10D show combinations that are the objective of the process for reducing the pigment ink dots Dp, and also schematically depict the pigment ink dots Dp and adjacent dye ink dots Dd after the reducing process.

Figure 10A:
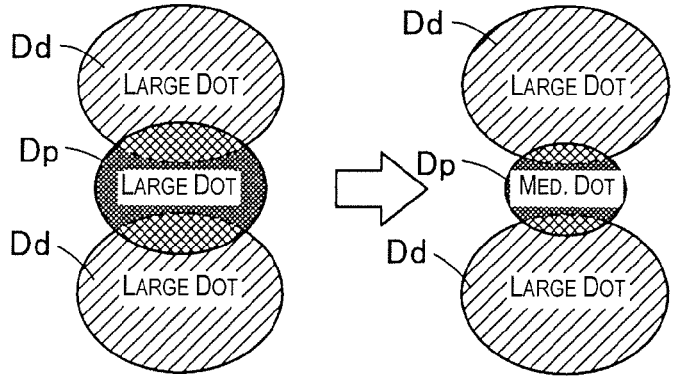
FIGS. 10A to 10D are schematic diagrams for describing the process of adjusting the size of pigment ink dots.
Figure 10B:
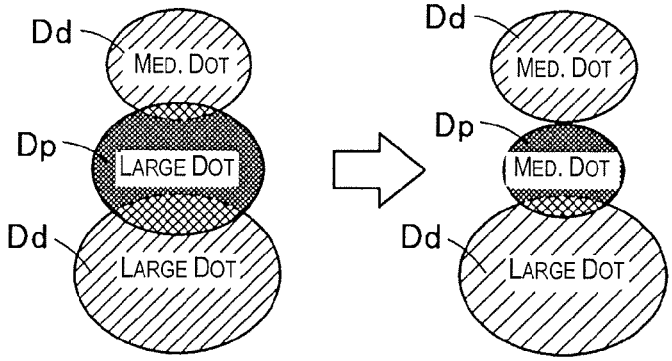
Figure 10C:
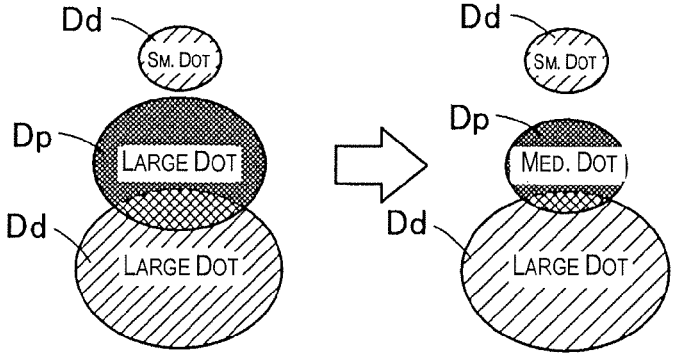
Figure 10D:
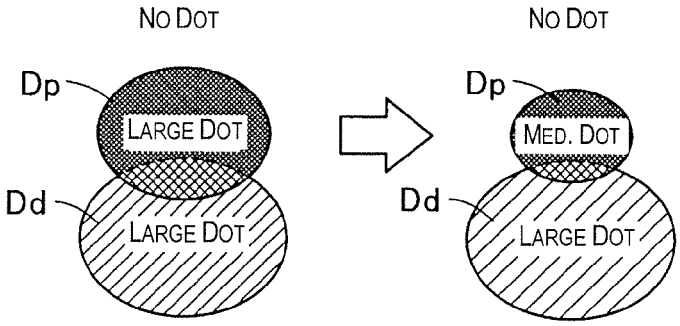

In the present embodiment, when a pigment ink dot Dp is large and at least one of the two dye ink dots Dd adjacent to the pigment ink dot Dp is also large, the size of the pigment ink dot Dp is reduced to medium. Specifically, FIG. 10A shows a case in which the pigment ink dot Dp is large and both of the two adjacent dye ink dots Dd are also large. FIGS. 10B and 10C show a case in which the pigment ink dot Dp is large and one of the adjacent dye ink dots Dd is large while the other is medium or small. FIG. 10D shows a case in which the pigment ink dot Dp is large and one adjacent dye ink dot Dd is formed large while the other is not formed. In all of these cases, the pigment ink dot Dp is formed in medium dot size during printing.

In the determination process in step S50, the amount of interference between the pigment ink dot Dp and the adjacent dye ink dots Dd may be determined to be large for combinations of dot sizes other than the combinations described in FIGS. 10A to 10D. In step S60, a process is performed for reducing the dot size of the pigment ink dot Dp from large to medium, but a reduction process of other dot sizes may also be performed. For example, when the pigment ink dot Dp is medium and the two adjacent dye ink dots Dd are both large, the pigment ink dot Dp may be changed to a small dot.

Commonly, depending on the type of print paper, the readiness of the ink to run may differ. Therefore, in the printing device 100 of the present embodiment, there are cases in which the size of the ink dots formed differs when the type of paper PP has changed. Specifically, in this case, there is a possibility that the change in the type of paper will yield a difference in the extent of overlap between the pigment ink dots and the dye ink dots adjacent to each other. Even when the size of the pigment ink dots has been changed in step S60, there is a possibility that the extend of overlap between the pigment ink dots and the adjacent dye ink dots after adjustment will not be the desired extent of overlap.

In view of this, in the determination process of step S50, the reference of determination may be varied according to the type of paper PP. For example, in the case of inkjet printing using normal paper, the ink commonly runs more readily than with glossy paper or other paper for inkjet printing. In view of this, when normal paper is used as the paper PP, the conditions for performing the process for varying the size of the pigment ink dots in step S60 may be more lenient than when glossy paper or other paper for inkjet printing is used. More specifically, when normal paper is used as the paper PP, there may be set a greater number of combinations of pigment ink dots and adjacent dye ink dots subjected to the process of step S60 than when paper for inkjet printing is used.

In the process for varying the size of pigment ink dots in step S60, one option is that the rate with which the pigment ink dot size is varied be changed according to the type of paper PP. Specifically, when normal paper is used as the paper PP, the pigment ink dots may be changed to a smaller size than when inkjet printing paper is used.

Thus, the extent of overlap between pigment ink dots and dye ink dots can be more appropriately adjusted by changing the reference of the determination process in step S50 or the variation rate of pigment ink dot size in step S60 in accordance with the type of paper PP. It is therefore possible to suppress the occurrence of concentration discrepancies between the advancing printed area and the retreating printed area during band printing using pigment ink and dye ink, described in FIG. 8C. The printing device 100 may acquire the type of paper PP from information that the user has set in advance via the personal computer 200.

In step S70 (FIG. 9), the print execution unit 23 applies any of the drive pulses P1*p* to P4*p* and P1*d* to P4*d* selected from the first or second drive signal DS1, DS2 to the nozzles 61Kp, 61Kd, in accordance with the size of the ink dots to be formed. The print head 60 is then moved in the primary scanning direction in order to form the next ink dot row. When the ink dot rows have finished being formed up to both ends of the printed image in the primary scanning direction, the print execution unit 23 conveys the paper PP equivalent to one band and reverses the movement direction of the print head 60. The print execution unit 23 thereafter repeats the process of step S20 through S70 until printing is finished (step S80).

Figure 11A:
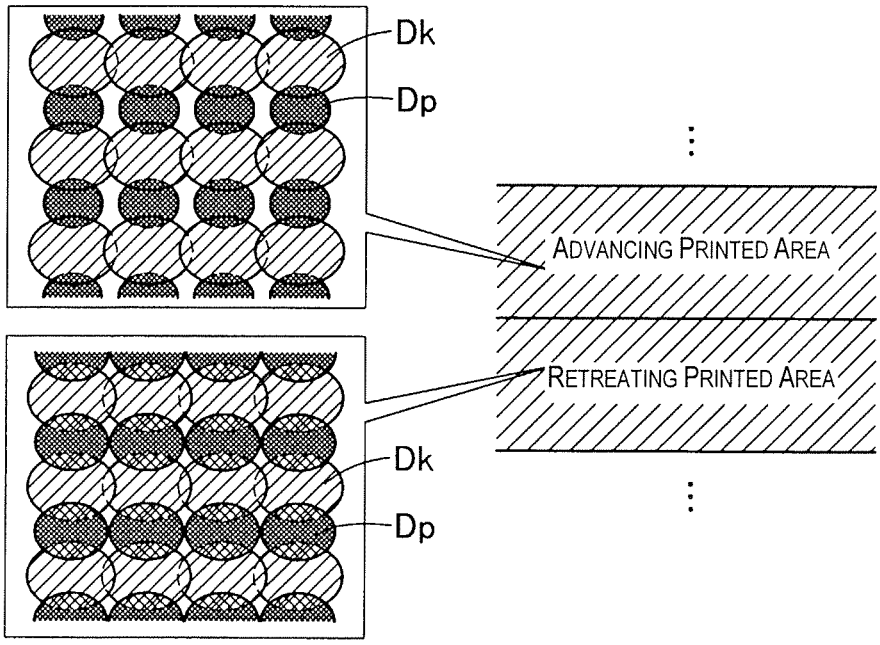
FIGS. 11A and 11B are schematic diagrams for describing the printing results of band printing.
Figure 11B:
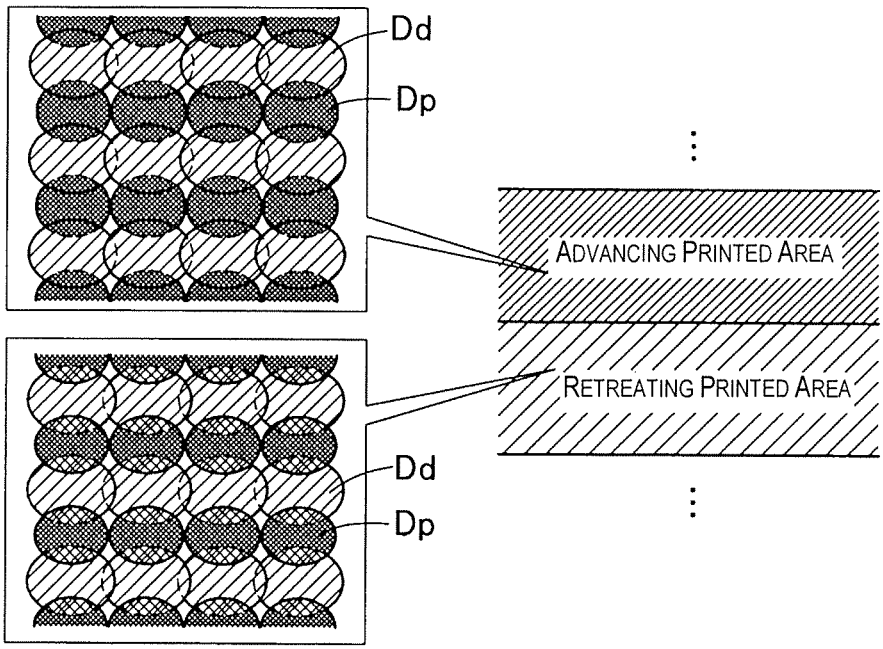

FIGS. 11A and 11B are schematic diagrams for describing the printing results of band printing in the printing device 100 of the present embodiment. FIG. 11A schematically shows the printing results of a case of forming a black solid image, wherein the formation of large ink dots has been established similarly for both dye ink and pigment ink in step S10. The right side of FIG. 11A shows part of a printed image including an advancing printed area and a retreating printed area, while the left side shows an enlarged view of an arrangement of ink dots Dp, Dd constituting the advancing printed area and the retreating printed area.

In this example, a substitution or reduction from large dots to medium dots is made in, the pigment ink dots Dp of the advancing printed area by the process in steps S40 to S60 in FIG. 9. The pigment ink dots Dp of the retreating printed area are formed in large dot size, which is the dot size acquired in step S20.

As a comparative example of FIG. 11A, FIG. 11B shows the printing results of forming a similar solid image and omitting the process of adjusting the size of the pigment ink dots Dp in steps S30 to S60, in the same manner as is depicted in FIG. 11A. When the size of the pigment ink dots Dp is left unchanged and all of the ink dots Dp, Dd constituting the solid image are formed as large dots, the concentration of the advancing printed area increases, the concentration of the retreating printed area decreases, and the concentration of the entire printed image becomes non-uniform, similar to what was described in FIG. 8C.

Figure 12A:
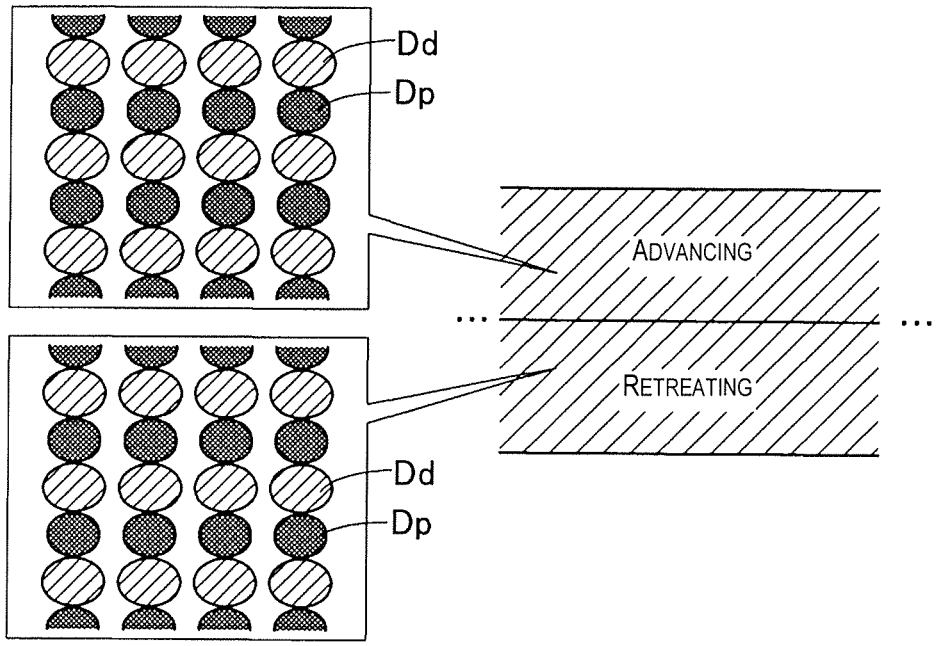
FIGS. 12A and 12B are schematic diagrams for describing the printing results of band printing.
Figure 12B:
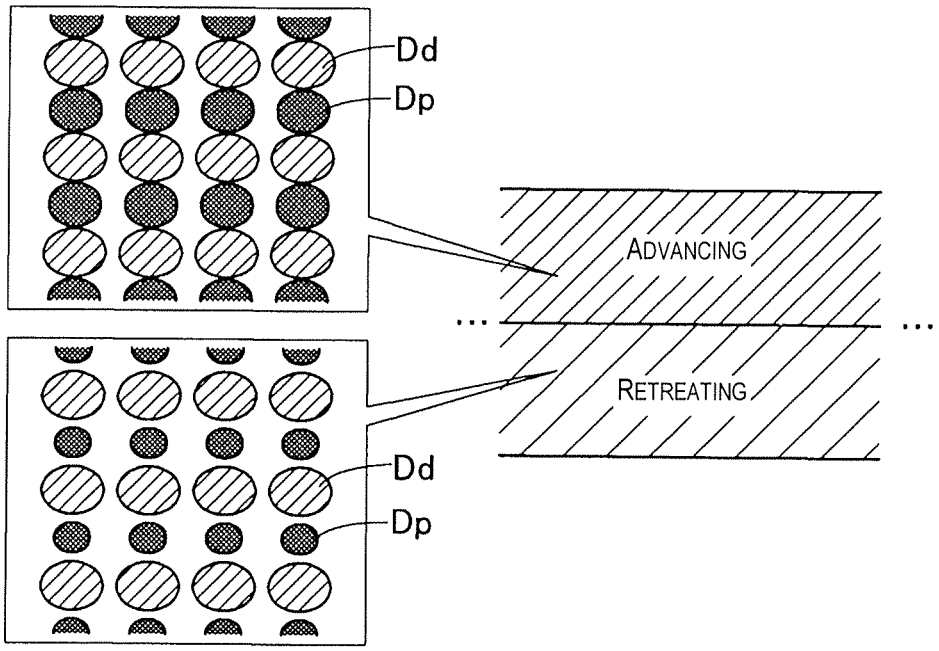

FIGS. 12A and 12B are schematic diagrams, similar to FIGS. 11A and 11B, for describing the printing results of band printing in the printing device 100 of the present embodiment. FIG. 12A schematically depicts the printing results when a black solid image is formed with a lower concentration than the example described in FIGS. 11A and 11B, when the formation of ink dots Dp, Dd in medium size is established for both pigment ink and dye ink in step S10.

In this case, the ink dots Dp, Dd constituting the advancing printed area do not correspond to any of the combinations of pigment ink dots Dp and adjacent dye ink dots Dd described in FIGS. 10A to 10D. Specifically, the extent of overlap between the pigment ink dots Dp and the adjacent dye ink dots Dd is lower than the predetermined extent, and the possibility of concentration discrepancies occurring as described in FIG. 11B is therefore low. Therefore, the pigment ink dots Dp are formed at the size acquired in step S20 (medium dot size in this case) in both the advancing printed area and the retreating printed area.

As a comparative example of FIG. 12A, FIG. 12B shows the printing results of forming a similar solid image similar to FIG. 12A and performing the process of varying the size of the pigment ink dots Dp in steps S30 to S60. In this comparative example, regardless of the fact that the extent of overlap between the pigment ink dots Dp and adjacent dye ink dots Dd is less than the predetermined extent, the size of the pigment ink dots Dp in the advancing printed area is reduced to small dots. Thus, when the determination process in step S50 is omitted and the dot size variation process of step S60 is applied to the pigment ink dots Dp constituting the advancing printed area, it will cause the concentration of the advancing printed area to be reduced and also concentration discrepancies to occur.

Both of the examples of FIGS. 11A, 11B, 12A and 12B described a case of forming a solid image, but such loss of printed image quality is not limited to instances of forming solid images, and also occurs similarly in cases in which photograph images or the like are band-printed using black dye ink and pigment ink. In such printed images, there is a possibility that the image will have an area in which the desired black concentration is not reproduced, and the printing quality decreases.

Thus, according to the printing device 100 of the present embodiment, it is possible to suppress the occurrence of concentration discrepancies in each printing area having a different order of overlap between the pigment ink dots Dp and the adjacent dye ink dots Dd. It is therefore possible to suppress the decrease in quality of a printed image formed by printing using pigment ink and dye ink.

B. Second Embodiment

Figure 13:
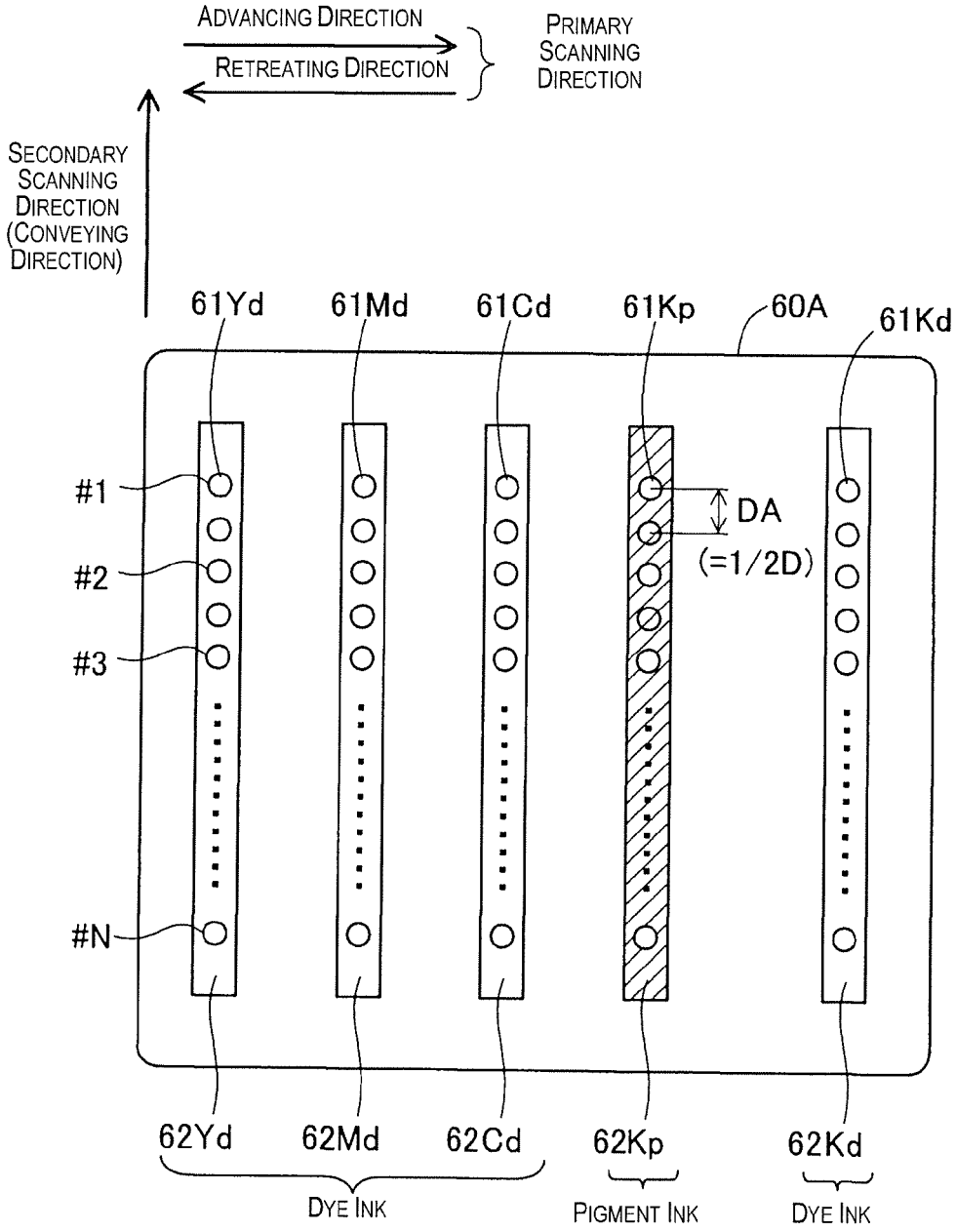
FIG. 13 is a schematic diagram showing the configuration of a print head of a printing device as a second embodiment.

FIG. 13 is a schematic diagram showing the configuration of a print head 60A of a printing device as a second embodiment of the present invention. FIG. 13 is substantially the same as FIG. 2 except that the nozzle pitch of the nozzles 61Yd, 61Md, 61Cd, 61Kp, 61Kd is different, and the formed positions of the fourth and fifth nozzles 61Kp, 61Kd are not offset from each other in the secondary scanning direction. The configuration of the printing device according to the second embodiment is otherwise identical to that of the printing device 100 of the first embodiment.

In the print head 60A of the present embodiment, the nozzle pitch DA of the nozzles 61Yd, 61Md, 61Cd, 61Kp, 61Kd is approximately half the nozzle pitch D of the first embodiment (DA=½D). The formed positions of the nozzles 61Kp for pigment ink and the formed positions of the nozzles 61Kd for dye ink are arrayed in rows in the primary scanning direction. In view of this, band printing described hereinbelow is performed using black pigment ink and dye ink with the printing device of the second embodiment.

Figure 14B:
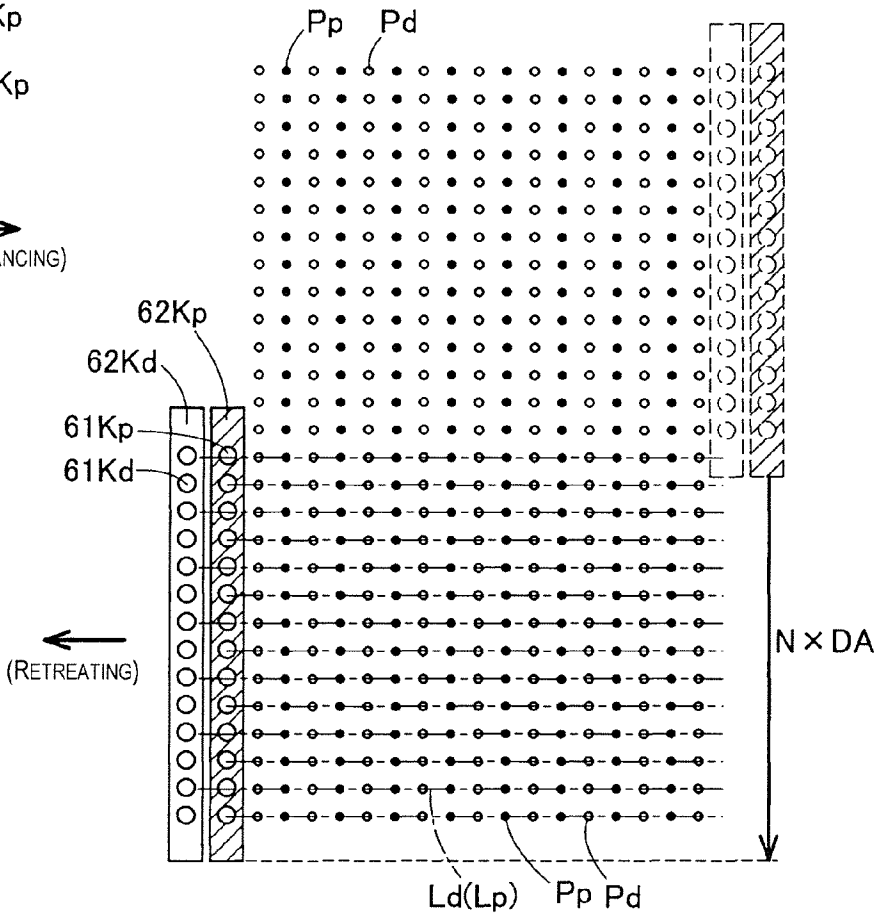
FIGS. 14A and 14B are schematic diagrams showing the step sequence of band printing performed by the printing device of the second embodiment.
Figure 14A:
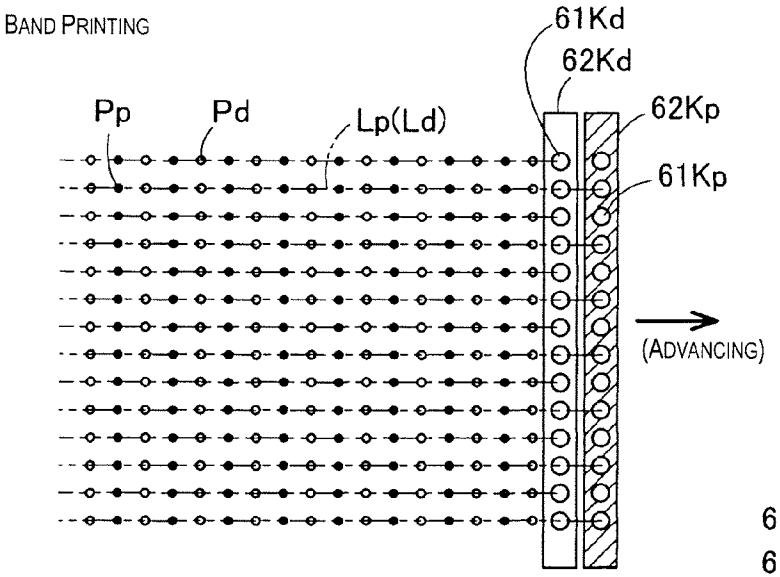

FIGS. 14A and 14B are schematic diagrams showing the sequence of steps of the band printing performed by the printing device of the second embodiment. FIGS. 14A and 14B are substantially the same as FIG. 7 except that different numbers of nozzles 61Kp, 61Kd are shown, the nozzle rows 62Kp, 62Kd are arranged in a different configuration, and the discharged positions Pp, Pd of dye ink and pigment ink have a different alignment. In FIGS. 14A and 14B, the single-dash lines and double-dash lines showing the movement trajectories Ld, Lp of the nozzles 61Kp, 61Kd overlap each other, and more emphasis is therefore given to depicting the movement trajectories of the nozzles that move first.

In the printing device of the second embodiment, ink discharge is performed so that pigment ink dots and dye ink dots are formed alternately in the primary scanning direction, both when the print head 60A moves in the advancing direction (FIG. 14A) and when the print head 60A moves in the retreating direction (FIG. 14B). Specifically, when band printing is being performed, the print head 60A alternately repeats between moving a distance of two printed pixels in the primary scanning direction and discharging ink. Dot rows of dye ink and dot rows of pigment ink which are adjacent to each other are therefore formed alternately on the paper PP.

When this type of band printing is performed, the order of overlapping between the pigment ink dots Dp and the dye ink dots Dd differs between the advancing printed area and the retreating printed area, similar to the first embodiment. Therefore, when band printing is performed in the printing device of the second embodiment, the same control process (FIG. 9) as in the first embodiment is executed. Thereby, when a solid image is printed combining black pigment ink and dye ink, the occurrence of concentration discrepancies between the advancing printed area and the retreating printed area is suppressed. In this second embodiment, the extent of overlap between the pigment ink dots and the dye ink dots adjacent to the pigment ink dots in the primary scanning direction is determined in the determination process of step S50.

Thus, according to the printing device of the second embodiment, it is possible to suppress the decrease in the printed image quality even during band printing in which dye ink dot rows and pigment ink dot rows are formed alternately in the primary scanning direction.

C. Modifications

The present invention is not limited to the working examples and embodiments described above, and various other aspects can be implemented within a range that does not deviate from the scope of the invention. For example, the following such modifications can be made.

C1. Modification 1

In the embodiments described above, some of the configuration achieved through hardware may be replaced with software, and conversely, some of the configuration achieved through software may be replaced with hardware. For example, it is also possible for some of the functions of the print execution unit 23 to be performed by other programs or other hardware.

C2. Modification 2

In the embodiments described above, in step S50 of the control process (FIG. 9) performed by the print execution unit 23, a determination was made of the extent of overlap between the pigment ink dots Dp and the dye ink dots Dd adjacent in the secondary scanning direction or the primary scanning direction. However, the determination process of step S50 need not determine only the extent of overlap with the adjacent dye ink dots Dd, and may determine the extent of overlap with dye ink dots Dd that are adjacent at an incline with respect to the primary scanning direction or the secondary scanning direction.

C3: Modification 3

In the control process (FIG. 9) of the embodiments described above, a process was performed during printing in the advancing printed area to vary the size of the pigment ink dots Dp so that the size was reduced (step S60). However, instead of this process, a process may be performed for enlarging the size of the pigment ink dots in the retreating printed area. With this process, it is possible to increase the quantity of pigment ink per unit surface area discharged in the retreating printed area, and to increase the concentration of the retreating printed area. It is therefore possible to suppress the occurrence of concentration discrepancies between the advancing printed area and the retreating printed area as described in FIGS. 8C and 11. A process may also be performed for reducing or enlarging the size of the pigment ink dots in both the advancing printed area and the retreating printed area so that the occurrence of concentration discrepancies between the advancing printed area and the retreating printed area is suppressed.

C4. Modification 4

In the embodiments described above, when the extent of overlap between the pigment ink dots Dp and the adjacent dye ink dots Dd is greater than the predetermined extent, an adjustment is made to the concentration of the printed image by varying the size of the pigment ink dots Dp. However, another option for when the extent of overlap between the pigment ink dots Dp and the adjacent dye ink dots Dd is greater than the predetermined extent is to make an adjustment to the concentration of the printed image by varying the size of the adjacent dye ink dots Dd. Specifically, in steps S50 to S60, this size adjustment for a first type of ink dots selected in advance from between the two types of ink dots Dp, Dd may be performed based on the extent of overlap with the adjacent second type of ink dots.

C5: Modification 5

In the embodiments described above, the printing device 100 used black pigment ink for printing. However, the printing device 100 may print using pigment ink of a color other than black either instead of black or in addition to black. In this case, the same process as in steps S40 to S60 in FIG. 9 may be performed on pigment ink dots and dye ink dots of a color other than the black pigment ink dots Dp.

C6. Modification 6

In the embodiment described above, the printing device 100 formed three sizes of ink dots on the paper PP: large dots, medium dots, and small dots. However, the printing device 100 may also form dots of other sizes on the paper PP.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

The term "arranged" as used herein to describe a component, section or part of a device may include hardware and/or software that is configured and/or programmed to carry out the desired function.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing device comprising:

pigment ink nozzles arranged to discharge pigment ink to form pigment ink dots on a print medium;

dye ink nozzles arranged to discharge dye ink to form dye ink dots on a print medium; and a nozzle control unit arranged to control sizes of the pigment ink dots and the dye ink dots by controlling ink quantities discharged from the pigment ink nozzles and the dye ink nozzles, the nozzle control unit being arranged to perform a first printing process for forming pigment ink dot rows and dye ink dot rows adjacent to each other by causing the pigment ink nozzles to form the pigment ink dots and then causing the dye ink nozzles to form the dye ink dots adjacent to the pigment ink dots, and a second printing process for forming the dye ink dot rows and the pigment ink dot rows adjacent to each other by causing the dye ink nozzles to form the dye ink dots and then causing the pigment ink nozzles to form the pigment ink dots adjacent to the dye ink dots, the nozzle control unit being arranged to form a printed image including first and second printed image areas formed respectively by the first and second printing processes, when the nozzle control unit forms a first type of ink dots selected in advance from between two types of ink dots including the pigment ink dots and the dye ink dots in the first or second printing process, the nozzle control unit being arranged to perform a dot size adjustment process in which the size of the first type of ink dots is not varied when the size of a second type of ink dots adjacent to the first type of ink dots is smaller than a preset size, and the size of the first type of ink dots is varied when the size of the second type of ink dots is equal to or greater than the preset size.

2. The printing device according to claim 1, wherein the nozzle control unit is arranged to perform the dot size adjustment process in the first printing process, the first type of ink dots are the pigment ink dots, and the second type of ink dots are the dye ink dots.

3. The printing device according to claim 1, further comprising a print head which has pigment ink nozzle rows and dye ink nozzle rows parallel to each other in which the pigment ink nozzles and the dye ink nozzles are aligned in an alignment direction at a prescribed nozzle pitch, and the print head being arranged to move back and forth in first and second directions that intersect the alignment direction of the pigment ink nozzle rows and the dye ink nozzle rows, the pigment ink nozzle rows and the dye ink nozzle rows being disposed in the print head such that the pigment ink nozzle rows are nearer the first direction and the dye ink nozzle rows are nearer the second direction, the pigment ink nozzles and the dye ink nozzles being offset from each other in the alignment direction, the first printing process including a process for printing the first printed image area while moving the print head in the first direction, the second printing process including a process for printing the second printed image area while moving the print head in the second direction, and the nozzle control unit being arranged to form the printed image on the print medium by alternately performing the first and second printing processes.

4. The printing device according to claim 1, wherein the nozzle control unit is arranged to vary at least one of either the preset size which is a threshold in the dot size adjustment process or a variation rate of the size of the first type of ink dots in the dot size adjustment process, the variation being according to the type of the print medium.

5. A printing method performed by a printing device having dye ink nozzles for discharging dye ink and pigment ink nozzles for discharging pigment ink, the printing method comprising:

forming a first printed image area including pigment ink dot rows and dye ink dot rows adjacent to each other by causing the pigment ink nozzles to form pigment ink dots and then causing the dye ink nozzles to form dye ink dots adjacent to the pigment ink dots;

forming a second printed image area including dye ink dot rows and pigment ink dot rows adjacent to each other by causing the dye ink nozzles to form the dye ink dots and then causing the pigment ink nozzles to form the pigment ink dots adjacent to the dye ink dots;

repeating the forming of the first printed image area and the forming of the second printed image area to form a printed image including the first printed image area and the second printed image area; and when a first type of ink dots selected in advance from between two types of ink dots including the pigment ink dots and the dye ink dots are formed during the forming of the first printed image area or the forming of the second printed image area, performing a dot size adjustment process in which the size of the first type of ink dots is not varied when the size of a second type of ink dots adjacent to the first type of ink dots is smaller than a preset size, and the size of the first type of ink dots is varied when the size of the second type of ink dots is equal to or greater than the preset size.

6. A non-transitory computer readable medium having stored thereon a program which is executable by a computer to cause a printing device to perform printing, the printing device including pigment ink nozzles arranged to discharge pigment ink to form pigment ink dots on a print medium and dye ink nozzles arranged to discharge dye ink to form dye ink dots on a print medium, the program controls the computer to execute function of:

controlling sizes of the pigment ink dots and the dye ink dots by controlling ink quantities discharged from the pigment ink nozzles and the dye ink nozzles;

performing a first printing process for forming pigment ink dot rows and dye ink dot rows adjacent to each other by causing the pigment ink nozzles to form the pigment ink dots and then causing the dye ink nozzles to form the dye ink dots adjacent to the pigment ink dots, and a second printing process for forming the dye ink dot rows and the pigment ink dot rows adjacent to each other by causing the dye ink nozzles to form the dye ink dots and then causing the pigment ink nozzles to form the pigment ink dots adjacent to the dye ink dots;

forming a printed image including first and second printed image areas formed respectively by the first and second printing processes; and when a first type of ink dots selected in advance from between two types of ink dots including the pigment ink dots and the dye ink dots are formed in the first or second printing process, performing a dot size adjustment process in which the size of the first type of ink dots is not varied when the size of a second type of ink dots adjacent to the first type of ink dots is smaller than a preset size, and the size of the first type of ink dots is varied when the size of the second type of ink dots is equal to or greater than the preset size.

* * * * *